US007588521B1

(12) United States Patent
Fazzari

(10) Patent No.: US 7,588,521 B1
(45) Date of Patent: Sep. 15, 2009

(54) PUSH-UP EXERCISE APPARATUS

(76) Inventor: Carlo Fazzari, 33 Simcoe Street East, Hamilton, ON (CA) L8L 3M9

( * ) Notice: Subject to any disclaimer, the term of this patent is extended or adjusted under 35 U.S.C. 154(b) by 0 days.

(21) Appl. No.: 12/232,974

(22) Filed: Sep. 26, 2008

(51) Int. Cl.
*A63B 71/00* (2006.01)
*A63B 26/00* (2006.01)

(52) U.S. Cl. ..... 482/141; 482/62

(58) Field of Classification Search ..... 482/62, 482/141, 38, 101, 135, 92, 79
See application file for complete search history.

(56) References Cited

U.S. PATENT DOCUMENTS 1,548,849 A * 8/1925 Henry ..... 482/128
2,666,640 A * 1/1954 Jennings, Sr. ..... 482/141
3,642,278 A * 2/1972 Hinckley ..... 482/38
3,707,285 A * 12/1972 Martin ..... 482/38
3,716,231 A * 2/1973 Martin ..... 482/144
3,731,921 A * 5/1973 Andrews, Jr. ..... 482/56
4,369,966 A * 1/1983 Silberman et al. ..... 482/38
4,527,797 A * 7/1985 Slade et al. ..... 482/101
5,033,741 A * 7/1991 Ganzer ..... 482/128
5,042,796 A * 8/1991 Jibril ..... 482/105
5,106,079 A * 4/1992 Escobedo et al. ..... 482/97
5,330,408 A * 7/1994 Westmoreland, Jr. ..... 482/141
5,503,101 A * 4/1996 Mullinix ..... 116/67 R
5,569,133 A * 10/1996 Vittone ..... 482/98
5,569,141 A * 10/1996 Chou ..... 482/144
5,669,859 A * 9/1997 Liggett et al. ..... 482/94
5,679,104 A * 10/1997 Driscoll ..... 482/91
5,711,749 A * 1/1998 Miller ..... 482/135
5,967,093 A * 10/1999 Vitt et al. ..... 119/705
6,050,926 A 4/2000 Purdie
6,217,483 B1 * 4/2001 Kallassy ..... 482/38
6,695,754 B1 * 2/2004 Gazzolo ..... 482/141
6,921,355 B2 7/2005 Campanaro et al.
7,060,014 B2 * 6/2006 Bergman et al. ..... 482/141
7,097,590 B2 * 8/2006 Canali ..... 482/24
7,104,936 B2 * 9/2006 Karlstrom ..... 482/137
7,125,371 B2 10/2006 Henderson
7,144,352 B2 12/2006 Hazan
7,156,788 B1 * 1/2007 Jackson et al. ..... 482/141
7,318,793 B2 1/2008 Dubrul et al.
7,326,153 B2 * 2/2008 Bond ..... 482/92
7,326,154 B2 2/2008 Foley
7,338,416 B2 * 3/2008 Smith ..... 482/104
7,367,928 B2 * 5/2008 Storch ..... 482/141
7,476,187 B2 * 1/2009 Corte ..... 482/141
2004/0097352 A1 * 5/2004 Bergman et al. ..... 482/141
2004/0110608 A1 * 6/2004 Washington ..... 482/96
2005/0227835 A1 * 10/2005 Hazan ..... 482/140
2005/0227836 A1 * 10/2005 Wen ..... 482/141
2005/0245371 A1 * 11/2005 Chen ..... 482/141
2005/0250628 A1 * 11/2005 Goldstein ..... 482/141

(Continued)

*Primary Examiner*—Lori Amerson
(74) *Attorney, Agent, or Firm*—Gowling Lafleur Henderson

(57) ABSTRACT

A device for performing weighted push-ups in a safe environment is provided. The device comprises a) a pair of hollow, parallel supports; b) a pair of essentially symmetrical L-shaped arms, comprising a vertically downward segment and a horizontal segment, said vertically downward segments adapted to be vertically moveable within said parallel supports ; c) a pair of essentially parallel guide elements affixed to the horizontal segment each of the L-shaped arms; and d) a weight support platform attached to upright rods that are slideable within the guide elements.

12 Claims, 3 Drawing Sheets

U.S. PATENT DOCUMENTS

2006/0035771 A1 2/2006 Gant
2006/0217246 A1* 9/2006 Payne ..... 482/96
2007/0032357 A1 2/2007 Plane, Jr.
2007/0298947 A1* 12/2007 Eksteen ..... 482/141
2008/0051273 A1* 2/2008 Storch ..... 482/141
2008/0070764 A1 3/2008 Amzallag et al.

* cited by examiner

PUSH-UP EXERCISE APPARATUS

FIELD OF INVENTION

The present invention relates to exercise equipment, specifically exercise equipment for performing a more effective push-up. The exercise equipment of the present invention provides better, faster results for strengthening and conditioning core upper body muscles.

BACKGROUND OF THE INVENTION

Performing pushups is well known to develop and maintain a strong upper body and general cardiovascular fitness. Push-ups use the body's own weight to increase upper body strength and thus this exercise is not limited by age or gender. Push-ups develop several muscles such as the pectoralis major in the chest, the deltoids, the scapular muscles and rotator cuff, the triceps and the upper back muscles. Push-ups develop general body strength and core body strength. A push-up can easily be performed on any flat surface.

While no specific equipment is required to perform a push-up, many people, as they increase their fitness level, want to increase the benefit they could get from ordinary push-ups. A higher level of strength endurance can be developed through a higher number of repetitions. However, for people who have a large degree of upper body strength, a push-up on a floor does not provide enough resistance to challenge that person's muscles. Additional resistance is required to push to the next level. One way to increase the intensity of push-ups is to add weights. This is termed a "weighted push-up". Typically, to perform a weighted push-up, the exerciser lies prone on the floor with hands slightly wider than the shoulder width and then raises his body up off the floor by extending the arms. A partner places weight plate(s) on the middle of the back and the push-ups are repeated. This type of pushup requires the help of a partner to secure the weight(s) on the exerciser's back. An alternative method of doing a weighted push-up is to use a weighted backpack, or a sandbag, or wear a weighted vest.

Descriptions of devices designed to enhance push-ups can be found, for example, in U.S. Pat. Nos. 6,050,926; 7,060,014; 7,318,793; 7,114,352; 5,033,741 and U.S. Patent Application Nos. US2008/0070764 and US2006/0035771.

The present invention provides a novel device for performing weighted push-ups that can used in a commercial gym or at home.

SUMMARY OF THE INVENTION

The present invention provides a novel device and method for performing weighted push-ups. Weighted push-ups are usually performed by applying a weight to the back, either with the aid of another person or in a backpack type of carrier.

In one aspect of the invention, there is provided a push-up device comprising first and second of hollow parallel supports and corresponding first and second essentially symmetrical L-shaped arms that comprise a vertically downward segment and a horizontal segment. The vertically downward segments are adapted to be vertically moveable within the parallel support. The device also includes a pair of hollow essentially parallel guide elements that are affixed to the horizontal segment of one of the L-shaped arms. A pair of upright rods are also provided as part of the device. Each rod slides up and down within one of the guide elements. An exercise weight support platform is connected on each side to a rod.

In a preferred embodiment, the supports and the vertical segments of the L-shaped arms include corresponding apertures that receive a locking mechanism for fixing the height of the arms. Preferred locking mechanisms include a pin lock or dowel that transverses corresponding apertures in the supports and the L-shaped arms.

In another preferred embodiment, the hollow support elements include a footer at the lower end. The footer may comprise a resilient pad. Some examples of resilient pads are rubber-based material or foam. Alternatively, resilient pad may include a spring.

In a preferred embodiment, the footer comprises a pair of opposing legs for stability.

In another preferred embodiment, the exercise weight support platform includes a cushion on its lower surface for additional comfort for the user. The weight support platform also includes a post to receive and hold at least one weight in position. In a further embodiment the device includes various exercise weights which can be applied to the weight support system.

BRIEF DESCRIPTION OF THE DRAWINGS

These and other features of the invention will become apparent from the following description in which reference is made to the appended drawings wherein.

DETAILED DESCRIPTION

The present invention provides a novel device for performing weighted push-ups. The device generally comprises two L-shaped arms attached indirectly to a weight support platform. The two L-shaped arms may be fixed height or they may be adjusted according to the arm length of the user The device may be provided as a single construction or the parts may be provided disassembled so that it can easily be transported or stored. The distance between the vertical segments of the two L-shaped arms should be sufficient for an exerciser to adjust the distance that their hands are apart. The device of the present invention is useful for performing push-up exercises at home or in a gym.

In general terms, the present invention provides a device such that an exerciser can perform a more effective push-up then can be done in the conventional unaided manner. The device of the present invention may be used alone or in combination with other push-up assistance devices such as hand grips.

Preferred embodiments of an exercise device according to the invention are described below with reference to the attached drawings.

Figure 1:
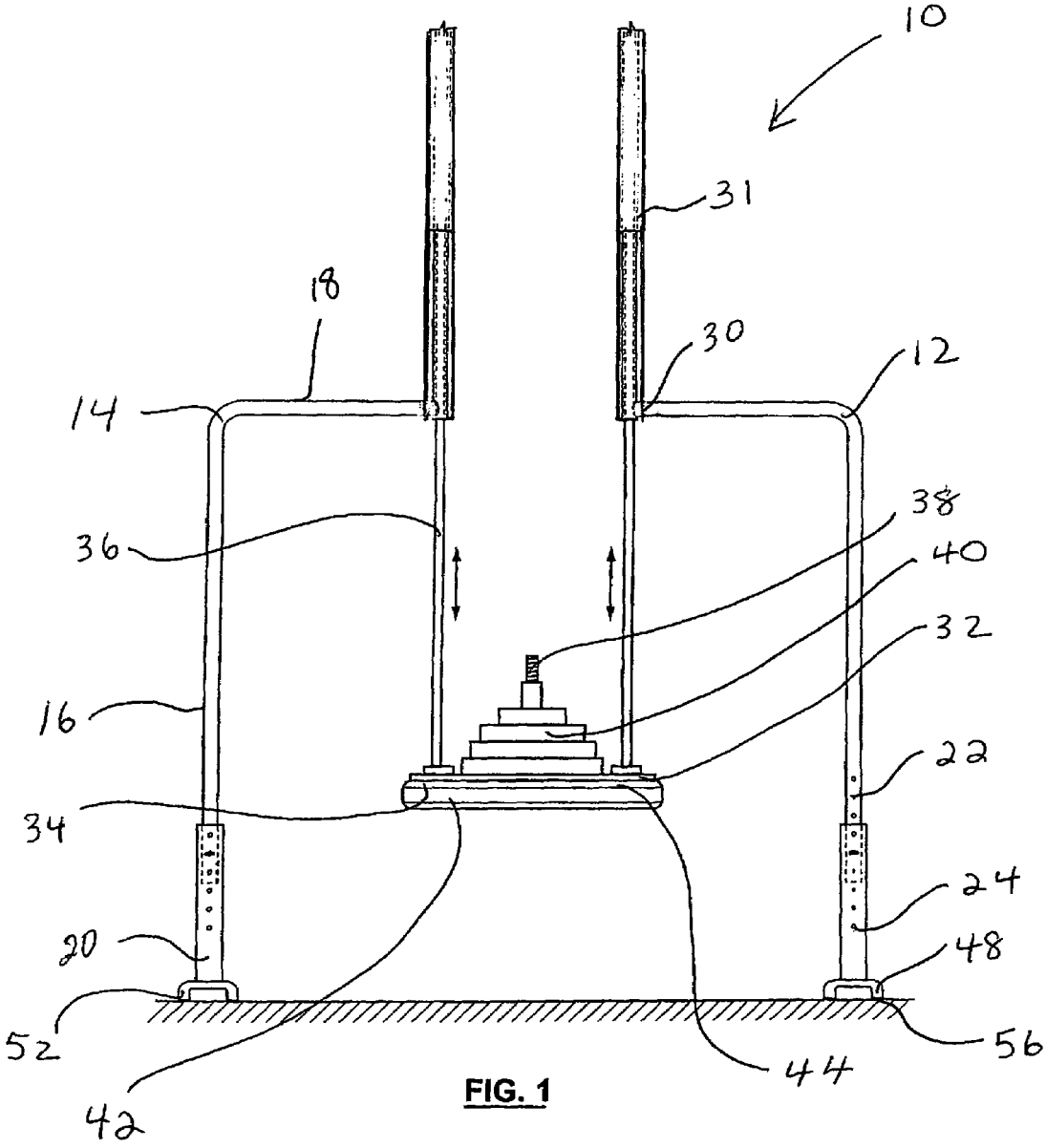
FIG. 1 illustrates an embodiment of the push-up device of the present invention.

FIG. 1 illustrates one embodiment of the invention. In this embodiment the device 10 comprises two opposite L-shaped arms 12, 14. The L-shaped arms comprise a vertical segment 16 and a horizontal segment 18. Each vertical segment fits within a hollow support 20. The vertical segments of the arms are vertically moveable within the hollow supports and can be locked in position by lining up a first aperture 22 on the arms and a second aperture 24 on the support and locking the arms in position by inserting a locking mechanism 28, such as a pin or dowel in the co-aligned apertures. It will be apparent to one skilled in the art that other mechanisms can be used to position the vertical segments with the hollow supports.

The L-shaped arms are attached at the end 30 of the horizontal segment 18 to essentially parallel guide elements 31. A weight support platform 32 comprises a base 34 and two parallel upright rods 36. The upright rods are slidable within the guide elements. The weight support base further includes a post 38 for holding weights 40 in position so that they do not slide off the weight platform. The weight support platform may optionally include padding 42 on the underside 44 to enhance the comfort of a user. In the illustrated embodiment the L-shaped arms are permanently attached to the guide elements. It is apparent, however, that the L-shaped arms may be connected in a detachable manner to the guide elements for easier storage or transport. A footer 48 may be provided at the end 50 of the hollow tubular support. The footer may be a solid one-piece footer or it may, as illustrated, comprise a pair of legs 52. The bottom 54 of the footer may comprise a resilient pad 56. Some possible examples of resilient pad materials include rubber based materials, foam, springs, and any other material that causes a cushioning effect. The footer may also comprise a wide base for stability.

In the illustrated embodiment, several weights of different weight have been applied to the platform. It is apparent that the number and weight of the load that is applied to this weight support platform can be varied according to the users strength.

Figure 2:
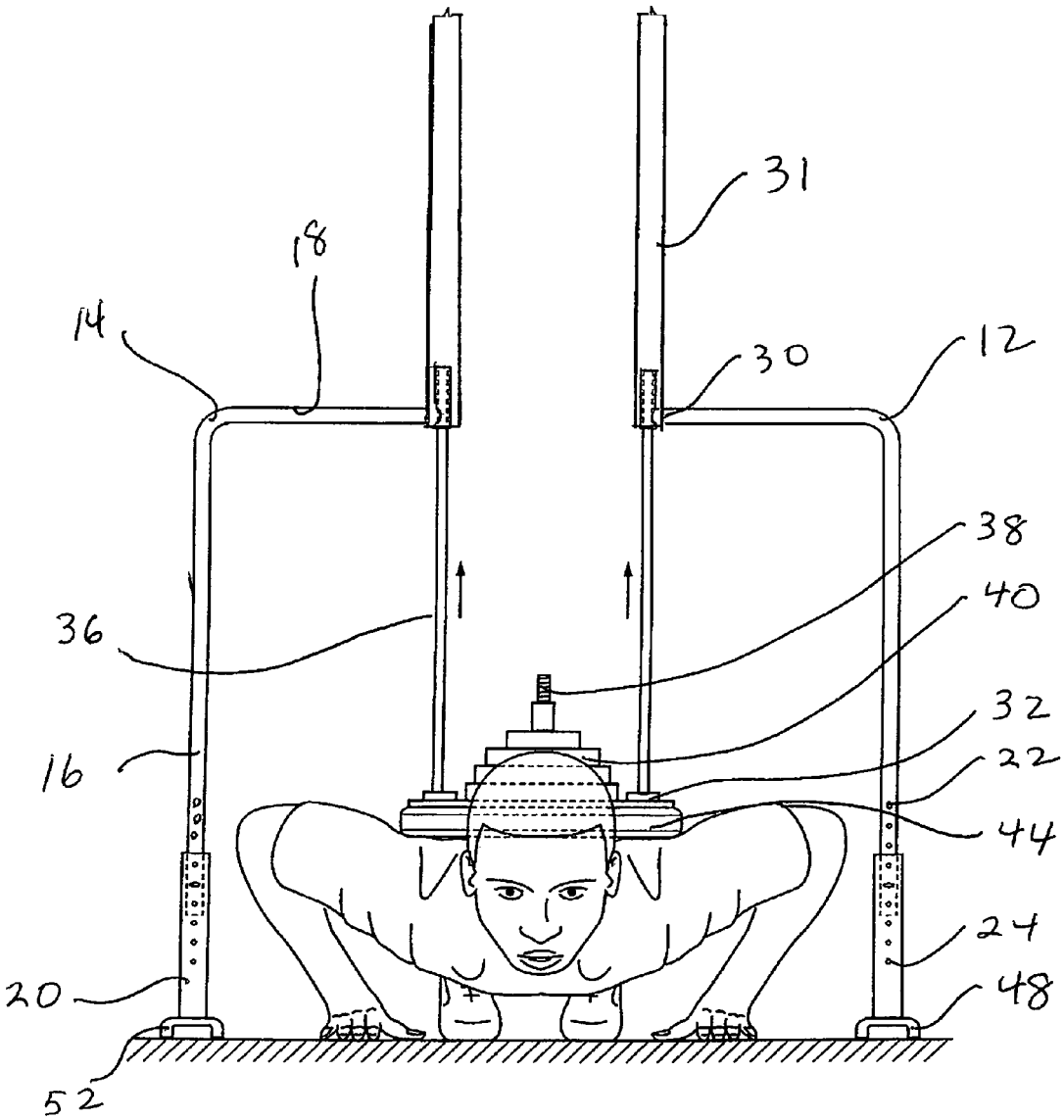
FIG. 2 illustrates the embodiment of FIG. 1 when the user is in the prone position.
Figure 3:
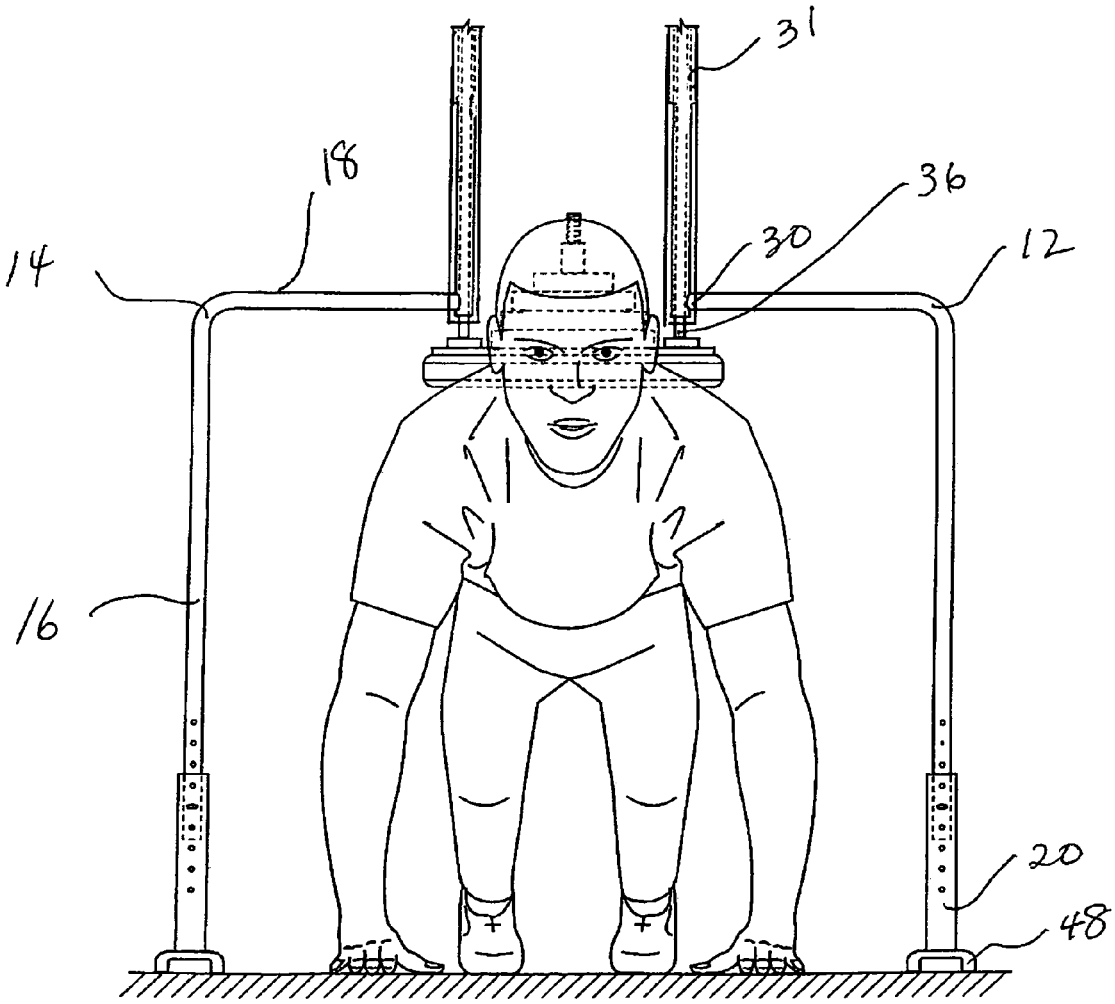
FIG. 3 illustrates the embodiment of FIG. 1 when the user is in the extended position.

FIGS. 2 and 3 illustrate the embodiment of FIG. 1 in use. In FIG. 2, the user is in the starting or prone position. The L-shaped arms 12, 14 which are moveable within the hollow tubular supports 20 have been adjusted and locked in position. The positioning is based on the resting position of the user and relates to the size of the user, their preferred hand width, their height, etc. Several weight 40 have been applied to the weight support platform 32 and locked in position with a clamp 38. The padding or cushion 42 on the lower surface of the weight support platform contacts the users back. Optionally, the device may include a strap that goes around the user's chest. The vertical segments 16 of the L-shaped arms are sufficiently distant so that a user can change the distance between their hands depending on which type of muscle they wish to improve.

FIG. 3 illustrates the device in use when the exerciser is in the extended or upper position of a push-up. As the user extends the arms the weights 40 are lifted on his back and the upright rods slide within the guide elements. Various facilitors, such as lubricants, hydraulics, etc can be incorporated to provide a smooth up and down motion. Alternatively, friction could be used to ensure a soft landing or to increase the resistance. However, the mechanism should not restrict upward and downward motion to an extent that would interfere with the performance of repeated push-ups.

The exercise device of the present invention may be fabricated from various types of materials. The entire device may be fabricated from one material or different parts may be fabricated from different materials. Materials used in the fabrication should be sturdy enough to withstand an extensive number of repetitions and to support a sizeable number of weights. A device according to the invention for use in a commercial gym may require sturdier materials than one designated for home use. Types of materials for the manufacture of exercise devices are well known to those skilled in the at.

The present invention provides a device for performing weighted push-ups that is safer and more effective than applying free weights to one's back. In addition, the streamlined design allows the device to be manufactured in a much more cost-effective manner than the conventional exercise equipment seen in gyms.

The above description of a preferred embodiment of the invention is given for explanatory purposes. It is not intended to limit the invention to the particular embodiment illustrated. It will be apparent to those skilled in the art that equivalent features may be substituted without departing from the scope of the invention.

What is claimed is:

1. A push-up device for performing weighted push-ups comprising:

a) first and second hollow, parallel supports supported on a horizontal surface;

b) first and second essentially symmetrical L-shaped arms, each comprising a vertical segment and a horizontal segment, wherein each vertical segment fits slidably within each parallel support;

c) a pair of hollow, essentially parallel guide elements each having an upper end and a lower end, wherein said lower end is affixed to the horizontal segment of one of the L-shaped arms;

d) an exercise weight support platform including a base and pair of upright rods, said base attached to a lower terminus of each rod, wherein each rod slides simultaneously within each of said pair of guide elements, e) at least one weight for placement on said base of said weight support platform, wherein the device is configured to be used by a user positioned face down, parallel to the horizontal surface and underneath said platform to performing weighted push-ups.

2. A push-up device according to claim 1, further comprising a locking mechanism for fixing the position of the vertical segment of each arm within the corresponding support.

3. A device according to claim 2, wherein the locking mechanism is a pin lock that transverses corresponding apertures in the supports and the vertical segment of the arms.

4. A device according to claim 2, wherein the locking mechanism is a dowel.

5. A device according to claim 1, wherein each parallel supports includes a footer.

6. A device according to claim 5, wherein the footer comprises a resilient pad.

7. A device according to claim 6, wherein the resilient pad is a rubber-based material.

8. A device according to claim 6, wherein the resilient pad is foam.

9. A device according to claim 5, wherein the footer comprises a base wider that the supports.

10. A device according to claim 5, wherein the footer comprises a pair of opposing legs.

11. A device according to claim 1, wherein the exercise weight support platform includes a cushioning material on its lower surface for contact with a user's back.

12. A device according to claim 1, further comprising various weights to be applied to the weight support platform.

* * * * *